United States Patent [19]

Minckler

[11] 3,951,099

[45] Apr. 20, 1976

[54] AUTOMATIC FEED FLUIDIZED BED SYSTEM

[75] Inventor: G. Mark Minckler, Guilford, Conn.

[73] Assignee: Electrostatic Equipment Corporation, New Haven, Conn.

[22] Filed: Apr. 11, 1974

[21] Appl. No.: 459,885

[52] U.S. Cl. ..... 118/7; 118/308; 118/630; 118/DIG. 5

[51] Int. Cl.[2] ..... B05B 7/14; B05B 5/02

[58] Field of Search ..... 118/7, 24, 308, 309, 118/312, 629, 630, DIG. 5

[56] References Cited

UNITED STATES PATENTS

| | | | |
|---|---|---|---|
| 362,927 | 5/1887 | Blake | 118/312 |
| 3,248,253 | 4/1966 | Barford et al. | 118/629 |
| 3,646,909 | 3/1972 | Cole et al. | 118/629 |
| 3,724,416 | 4/1973 | Diamond et al. | 118/7 |
| 3,799,112 | 3/1974 | Huteaux | 118/DIG. 5 |
| 3,828,729 | 8/1974 | Goodridge | 118/DIG. 5 |

*Primary Examiner*—Mervin Stein
*Assistant Examiner*—Douglas Salser

[57] ABSTRACT

A coating system employs a fluidized bed unit in which the porous plate is inclined to promote flow of the coating powder from the feed point to a subjacent location. Means is provided to sense the level of the coating powder at the subjacent location of the plate, and to control its discharge into the unit in response thereto. The incline of the plate minimizes the lag between the feed and sensing operations, thereby affording accurate correlation between the amount of powder introduced and the actual need.

10 Claims, 1 Drawing Figure

AUTOMATIC FEED FLUIDIZED BED SYSTEM

BACKGROUND OF THE INVENTION

The attainment of satisfactory results with any fluidized bed apparatus depends, of course, upon the provision of an adequate supply of coating material in all operative portions of the fluidization unit; generally, the maintenance of a uniform, predetermined level of powder is also of significant importance. In many instances, practical operation demands that the supply be replenished automatically, but difficulties have been encountered in accurately correlating the feed function to the true requirements of the system.

Accordingly, it is an object of the present invention to provide a novel fluidized bed coating system in which the replenishment of coating material in the fluidized bed is accurately correlated to actual need.

It is also an object of the invention to provide such a system in which the level of fluidization is automatically maintained fairly constant and uniform within the coating unit.

Another object of the invention is to provide such a system in which the fluidized bed unit is elongated.

Still another object is to provide an electrostatic coating system having the foregoing features and advantages.

A further object is to provide a system in which such control of the powder supply is simply and yet effectively achieved.

SUMMARY OF THE DISCLOSURE

It has now been found that the foregoing and related objects of the invention are readily attained in an automatic feed, fluidized bed coating system comprising a fluidized bed unit including a housing having an inclined, substantially planar porous plate member disposed therein, which plate member defines a coating chamber thereabove and a plenum therebelow. Means is provided for introducing a gas under pressure into the plenum, and feed means is provided for dispensing a particulate coating material and depositing it upon the plate member at a location adjacent the upper end thereof. The system also includes means for sensing the level of the coating material within the coating chamber at a subjacent location of the plate member, and it also includes means responsive to the sensing means for the control of discharge of coating material from the feed means. The inclination of the plate member promotes the flow of coating material thereupon, from the upper end location to the subjacent location thereof, so that the sensing means may thereby provide an accurate indication of the coating material needs of the unit.

In the preferred embodiments, the housing of the fluidized bed unit is substantially horizontally disposed, with the plate member thereof being angularly positioned therewithin. Generally, the unit will be elongated, and will have the plate member inclined along the longitudinal axis thereof. The fluidized bed unit may advantageously include means in the housing for vertically dividing the plenum into a plurality of adjacent chambers, with the gas-introducing means being adapted to supply gas to each of the chambers at a different rate.

The system may additionally include conveyor means for the workpiece to be coated, in which case the plate member is desirably inclined in the direction of forward movement thereof. Most desirably, the system will also include means for electrostatically charging the coating material introduced into the coating chamber of the unit.

DETAILED DESCRIPTION OF THE ILLUSTRATED EMBODIMENT

Figure 1:
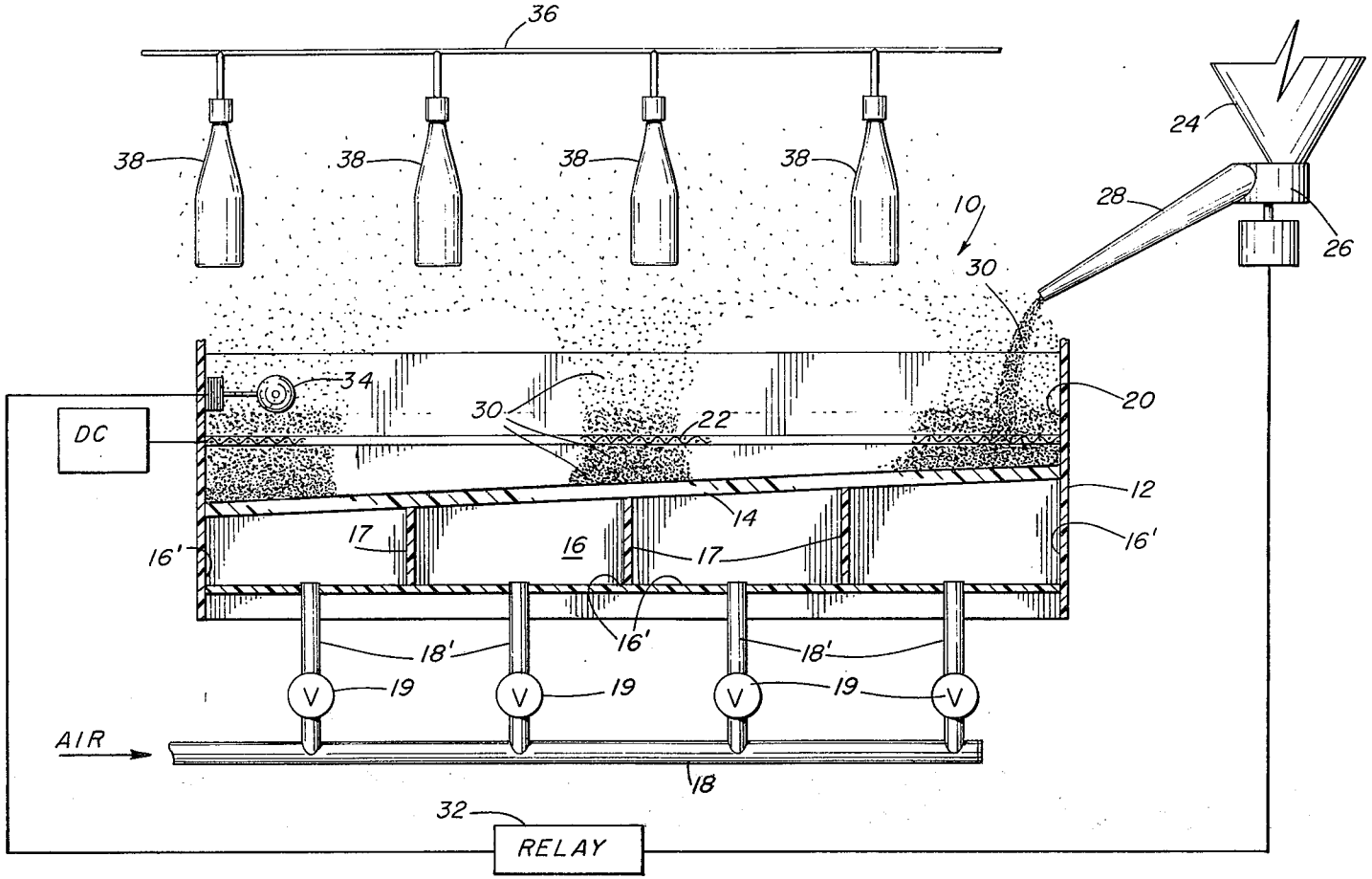
FIG. 1 is schematic illustration of a coating system embodying the present invention, with the fluidized bed unit thereof shown in vertical section.

Turning now in detail to FIG. 1, the system illustrated comprises a horizontally-disposed fluidized bed unit, generally designated by the numeral 10, consisting of a housing 12 in which a planar porous plate 14 is mounted. The plate 14 is disposed at a slight angle to horizontal (the angle being exaggerated in the drawing for emphasis), and it defines an underlying plenum 16 and an overlying coating or fluidization chamber 20 in the lower and upper portions of the housing 12, respectively. A conduit 18 is provided to supply fluidizing gas (normally air) to the plenum 16, and an electrode grid 22, which is connected to a direct current source, is horizontally positioned over the plate 14, for electrostatic charging of the particles of coating material. As will be noted, in the illustrated embodiment the plenum 16 is divided into a plurality of separate chambers 16' by the vertical partitions 17 extending thereacross. In addition, the conduit 18 has a number of short legs 18', one of which is connected to each chamber 16'; each leg 18' has a valve 19 therein to enable control of the air flow rate into the corresponding chamber 16' .

A powder supply unit 24, fitted with a motor-driven rotary metering valve 26, is positioned adjacent the fluidized bed unit 10, and has a feed nozzle 28 disposed to discharge coating powder 30 upon the porous plate 18, at a location near the upper, or most elevated, end thereof. The motor for the valve 26 is wired through a relay 32 to a fluidic sensing device 34, which is mounted within the coating chamber 20 over the lower end of the plate 18 (if desired, the electrode grid 22 may be omitted in this area, so that the electrostatic effect does not introduce undue inaccuracy into the level-detection function). Finally, conveyor 36 is provided to transport a succession of objects 38 over the unit 10 for coating, with the direction of forward movement thereof being indicated by the arrows.

As the powder 30 gradually becomes depleted during the coating operation, the level thereof over the plate 14 falls, until the fluidic sensor 34 ultimately detects a deficiency in the supply. An appropriate signal is thereby sent to the relay 32, which, in turn, activates the valve 26 of the supply unit 24, to discharge a quantity of powder 30 through the nozzle 28 and deposit it upon the surface of the plate 14 adjacent its upper end. The inclination of the plate 14 (coupled with the fluidizing action of air passing upwardly from the plenum 18, and possibly with other effects, such as agitation or vibration) promotes flow of the powder 30 toward the lower end of the plate 14, whereat its level is sensed by the device 34.

As will be appreciated, in the initial detection of the deficiency of powder, the sensing device 34 provides an accurate indication, because the flow-encouraging features of the instant system virtually prevent accumulations of powder at the feed end of the unit 10, which accumulations would result in a false indication of deficiency. On the other hand, when the addition of powder has been called-for and initiated, the quick response of the system permits the feed operation to be terminated promptly upon attaining the desired predetermined amount of powder in the coating chamber. In some instances, it may be desirable to incorporate a timed feed cycle into the system, in which event the sensor will, after detecting an initial need, simply continue to signal successive feed cycles until the deficiency has been satisfied.

While the level of fluidized coating material 30 will be substantially uniform across the entire chamber 20, its depth will vary due to the slope of the plate 14. Since the rate of air flow required for fluidization is dependent upon the depth of the material, it will be appreciated that the depth variation present in the unit illustrated requires that it be adapted to provide different air flow rates in its various parts, to achieve maximum uniformity of fluidization. The separately-controlled plenum chambers 16' admirably serve that function; in normal operation of the apparatus shown, the more rightward their positions, the lower the air flow rate to each of the chambers 16'.

As noted previously, the incline of the plate 14, as depicted in the drawing, is somewhat exaggerated. Ideally, the angle should be one which is just sufficient to induce adequate flow across the plate from the feed end, and not be so great as to cause an excessive variation in the depth of the coating material from one end to the other. The plate may be adjustable to facilitate attainment of the optimum angle, which generally will be in the range of about 0.5° to 3.0° degrees, and preferably about 0.7° to 1.0°, from horizontal, depending largely upon the length of the unit. It should be appreciated that, as used herein, the terms "porous plate" and "porous plate member" are intended to encompass not only the ceramic and plastic plates and the so called "membranes", which are conventionally employed, but also structures which are functionally equivalent thereto.

In many instances, it will be necessary or desirable to utilize an elongated fluidized bed unit in the system, in which cases the advantages of the instant invention are especially notable, due to the greater time required for material transfer therein. While it is apparent that time would not be a factor if the sensor were to be positioned near the feed point, it will also be evident that the objects of the invention would thereby tend to be frustrated, since such an arrangement would provide little indication of conditions throughout the bed. Generally, those objectives will best be served by locating the feed and sensing points near opposite ends of the unit, and preferably the spacing therebetween will be maximized.

The illustrated powder feed subsystem, (i.e., the powder supply unit 24, the sensing device 34 and the relay 32) is, of course, merely illustrative, and can be modified extensively or replaced with an entirely different arrangement, if so desired. It is only necessary that there be provided means by which the powder may be supplied to the coating chamber of the fluidized bed unit in automatic response to a detected demand; this may be accomplished by mechanical, electrical, pneumatic or other means, or by combinations of such means, as appropriate. Nevertheless, it might be mentioned, as a specific example, that an effective sensing device is sold by Norgren Fluidics of Littleton, Colorado under the name FEATHERFLEX 5FS-010-000, and that the powder feed mechanism may advantageously utilize a rotary, circumferentially-indented or star-type wheel, to pick up the powder from an upper reservoir and to carry it to a delivery conduit therebelow.

While the system of the invention may be adapted for coating by non-electrostatic means (such as by passing heated parts through a bed of thermoplastic particles), in many instances electrostatic coating will offer significant advantage, and the concepts of the instant invention are highly beneficially applied thereto. Again, the grid-type electrode is merely exemplary of the various means that can be used for electrostatic charging of the particles, and the configuration, construction and location thereof may vary greatly; indeed, highly ionized gas may be employed as the electrostatic charging means of the system.

Insofar as the conveyor means is concerned, its design will depend largely upon the nature of the workpiece to be coated. As shown, the illustrated mechanism is adapted to support bottles or like containers for transport along a travel path over the coating unit. A similar system can be used for coating wire, strip stock, or comparable "continuous-length" workpiece, simply by substituting an appropriate mechanism for carrying the workpiece near the fluidized bed. As will be appreciated, in an electrostatic system, the conveyor would normally be electrically grounded, and such a system would appropriately employ parts (especially of the coating unit) fabricated from plastic, for operational and safety reasons.

Virtually any finely-divided material that is commonly deposited from fluidized bed apparatus may be employed in the system hereof, and the term "particulate coating material" is intended to be fully inclusive thereof. Such materials include not only the widely-used natural and synthetic resins, but also inorganic powders, such as talc, chalk, metals and the like, as well as fibrous substances such as asbestos and other flocs that are adapted to fluidization.

Thus, it can be seen that the present invention provides a novel fluidized bed coating system in which the replenishment of coating material in the fluidized bed unit is accurately correlated to actual need, and in which the fluidization of the coating material is automatically maintained fairly constant and uniform within the coating unit. The system is especially adapted to accommodate an elongated fluidized bed unit and electrostatic operation, and control of the powder supply is simply and yet effectively achieved therein.

Having thus described the invention, what is claimed is:

1. An automatic feed, fluidized bed coating system comprising, in combination: a fluidized bed unit including a housing having an inclined, substantially planar porous plate member disposed therein to define a coating chamber thereabove and a plenum therebelow; means for introducing a gas under pressure into said plenum; feed means for dispensing a particulate coating material and depositing it upon said plate member at a location adjacent the upper end thereof; means for sensing the level of the coating material within said coating chamber at a subjacent location of said plate member spaced from said end location; and means responsive to said sensing means for the control of discharge of coating material from said feed means, the inclination of said plate member promoting the flow of coating material upon said plate member from said upper end location to said subjacent location thereof, so that said sensing means may thereby provide an accurate indication of the coating material needs of said unit.

2. The system of claim 1 wherein said housing of said unit is substantially horizontally disposed, and wherein said plate member thereof is angularly positioned therewithin.

3. The system of claim 1 wherein said unit is elongated, and wherein said plate member is inclined along the longitudinal axis thereof.

4. The system of claim 1 additionally including conveyor means for the workpiece to be coated, and wherein said plate member of said unit is inclined in the direction of forward movement of said conveyor means.

5. The system of claim 1 additionally including means for electrostatically charging the coating material introduced into said coating chamber of said unit.

6. The system of claim 1 wherein said fluidized bed unit additionally includes means in said housing for vertically dividing said plenum into a plurality of adjacent chambers, and wherein said gas-introducing means is adapted to supply gas to each of said plenum chambers at a different rate.

7. An automatic feed, fluidized bed coating system comprising, in combination: a fluidized bed unit including a housing having an inclined, substantially planar porous plate member disposed therein to define a coating chamber thereabove and a plenum therebelow, and having means for vertically dividing said plenum into a plurality of adjacent chambers; means for introducing a gas under pressure into each of said plenum chambers at a different rate; feed means for dispensing a particulate coating material and depositing it upon said plate member at a location adjacent the upper end thereof; means for sensing the level of the coating material within said coating chamber at a subjacent location of said plate member spaced from said end location; and means responsive to said sensing means for the control of discharge of coating material from said feed means, the inclination of said plate member promoting the flow of coating material upon said plate member from said upper end location to said subjacent location thereof, so that said sensing means may thereby provide an accurate indication of the coating material needs of said unit, and control of the rate of gas introduction into each of said plenum chambers may permit compensation to be made for differences in depth of coating material, so as to enable uniform fluidization throughout.

8. The system of claim 7 wherein said housing of said unit is substantially horizontally disposed, and wherein said plate member thereof is angularly positioned therewithin.

9. The system of claim 7 wherein said unit is elongated, and wherein said plate member is inclined along the longitudinal axis thereof.

10. The system of claim 7 additionally including means for electrostatically charging the coating material introduced into said coating chamber of said unit.

* * * * *